US008354891B2

(12) United States Patent
Hino et al.

(10) Patent No.: US 8,354,891 B2
(45) Date of Patent: Jan. 15, 2013

(54) NONRECIPROCAL CIRCUIT ELEMENT

(75) Inventors: Seigo Hino, Nagaokakyo (JP); Yoshiki Yamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 67 days.

(21) Appl. No.: 13/182,463

(22) Filed: Jul. 14, 2011

(65) Prior Publication Data

US 2012/0019332 A1 Jan. 26, 2012

(30) Foreign Application Priority Data

Jul. 20, 2010 (JP) ..... 2010-162946

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

2009/0058551 A1 3/2009 Wada et al.

FOREIGN PATENT DOCUMENTS

| | | | |
|---|---|---|---|
| CN | 1088709 | A | 6/1994 |
| JP | 63-315550 | A | 12/1988 |
| JP | 63-315555 | A | 12/1988 |
| JP | 63-315556 | A | 12/1988 |
| JP | 07-235405 | A | 9/1995 |
| WO | 2009/028112 | A1 | 3/2009 |

*Primary Examiner* — Stephen Jones

(74) *Attorney, Agent, or Firm* — Keating & Bennett, LLP

(57) ABSTRACT

A nonreciprocal circuit element includes first and second center electrodes. On a ferrite to which a direct-current magnetic field is applied from a permanent magnet, the first and second center electrodes are insulated and intersect. First and second ends of the first center electrode are connected to an input port and an output port, respectively. First and second ends of the second center electrode are connected to the output port and a ground port, respectively. A first matching capacitor and a resistor are connected between the input port and the output port. A second matching capacitor is connected between the output port and the ground port. A parallel resonant circuit is connected in parallel to the resistor. A coupling element is connected between the parallel resonant circuit and another parallel resonant circuit including the first center electrode and the first matching capacitor so as to the parallel resonant circuits.

4 Claims, 9 Drawing Sheets

NONRECIPROCAL CIRCUIT ELEMENT

BACKGROUND OF THE INVENTION

1. Field of the Invention

The present invention relates to nonreciprocal circuit elements, and, more particularly, to a nonreciprocal circuit element such as an isolator or a circulator used in a microwave band.

2. Description of the Related Art

A nonreciprocal circuit element such as an isolator or a circulator has a characteristic of transmitting a signal in only a predetermined direction and transmitting no signal in the opposite direction, and is used in, for example, a transmission circuit of a mobile communication device such as a car phone or a mobile phone.

WO Publication No. 2009/028112 discloses, as this kind of nonreciprocal circuit element, a two-port isolator in which a first center electrode and a second center electrode intersect and are insulated from each other on a ferrite surface and an LC series resonant circuit including a capacitor and an inductor is connected in parallel to the first center electrode and is connected in series to a terminating resistor. When high-frequency power is input into this two-port isolator from an inverse direction, the impedance characteristics of the terminating resistor and the LC series resonant circuit achieve matching in a wide frequency band. As a result, an isolation characteristic is improved. On the other hand, when high-frequency power is input into this two-port isolator from a forward direction, the high-frequency power hardly flows through the first center electrode and the terminating resistor. Accordingly, the degradation in an insertion loss due to the addition of the LC series resonant circuit can be ignored.

In the two-port isolator, the inductor included in the LC series resonant circuit needs to have an inductance value in the range of approximately 60 nH to approximately 80 nH. It is assumed that a chip coil with a length of approximately 0.6 mm, a width of approximately 0.3 mm, and a height of approximately 0.3 mm is used as an inductor having the above-described inductance value. In this case, since the self-resonance frequency of the chip coil is approximately 1 GHz, the chip coil cannot be used in a nonreciprocal circuit element that operates at a frequency equal to or larger than approximately 1 GHz. This problem can be solved by connecting a plurality of chip coils having a small inductance value in series or using a large-sized chip coil whose self-resonance frequency is high.

However, this leads to increases in a product size and a cost. In addition, since the allowable current of a chip coil is reduced with the increases in an inductance value, the conductor of the chip coil may be broken by high-frequency power reflected from an antenna. This leads to unreliability.

On the other hand, the capacitor included in the LC series resonant circuit needs to have a small capacitance value in the range of approximately 0.1 pF to approximately 0.4 pF. However, in a capacitor having a small capacitance value, an effective capacitance value is significantly changed because of the variation in a stray capacitance, which cannot be avoided, and an isolation characteristic varies greatly. It is therefore difficult to stably mass-produce nonreciprocal circuit elements having a desired characteristic.

SUMMARY OF THE INVENTION

Preferred embodiments of the present invention provide a nonreciprocal circuit element capable of improving an isolation characteristic without degrading an insertion loss, operating reliably in a high frequency band, and preventing variations in the isolation characteristic.

A nonreciprocal circuit element according to a preferred embodiment of the present invention includes a permanent magnet, a ferrite arranged to receive a direct-current magnetic field from the permanent magnet, a first center electrode that is disposed on the ferrite and includes a first end electrically connected to an input port and a second end electrically connected to an output port, a second center electrode that is disposed on the ferrite and includes a first end electrically connected to the output port and a second end electrically connected to a ground port, a first matching capacitor electrically connected between the input port and the output port, a second matching capacitor electrically connected between the output port and the ground port, a resistor electrically connected between the input port and the output port, a first parallel resonant circuit including an inductor and a capacitor and is connected in parallel to the resistor, and a coupling element that is electrically connected between the first parallel resonant circuit and a second parallel resonant circuit including the first center electrode and the first matching capacitor and is configured to connect the first parallel resonant circuit and the second parallel resonant circuit. The first center electrode and the second center electrode are insulated from each other and intersect.

In the nonreciprocal circuit element, when a high-frequency current is input into the output port, the impedance characteristics of the first parallel resonant circuit and the second parallel resonant circuit achieve matching in a wide frequency band. As a result, an isolation characteristic is improved. On the other hand, when a high-frequency current flows from the input port to the output port, a large high-frequency current flows through the second center electrode and a high-frequency current hardly flows through the two parallel resonant circuits. Accordingly, an insertion loss resulting from the addition of the first parallel resonant circuit can be ignored, and an insertion loss is not increased.

In particular, the inductor included in the second parallel resonant circuit may have a small inductance value, and can be therefore applied to a nonreciprocal circuit element operable at up to approximately 6 GHz that is the self-resonance frequency of a small chip coil. Since the allowable current of a chip coil having a small inductance value is large, an electrode is not broken by high-frequency power reflected from an antenna. Accordingly, reliability is increased. Furthermore, since the capacitor included in the second parallel resonant circuit has a relatively large capacitance value, the amount of change in an effective capacitance value is small even if there are some changes in a stray capacitance. Accordingly, the variation in an isolation characteristic is prevented and minimized.

According to various preferred embodiments of the present invention, it is possible to improve an isolation characteristic while maintaining an insertion loss, achieve reliable operation in a high frequency band, and prevent variations in the isolation characteristic.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
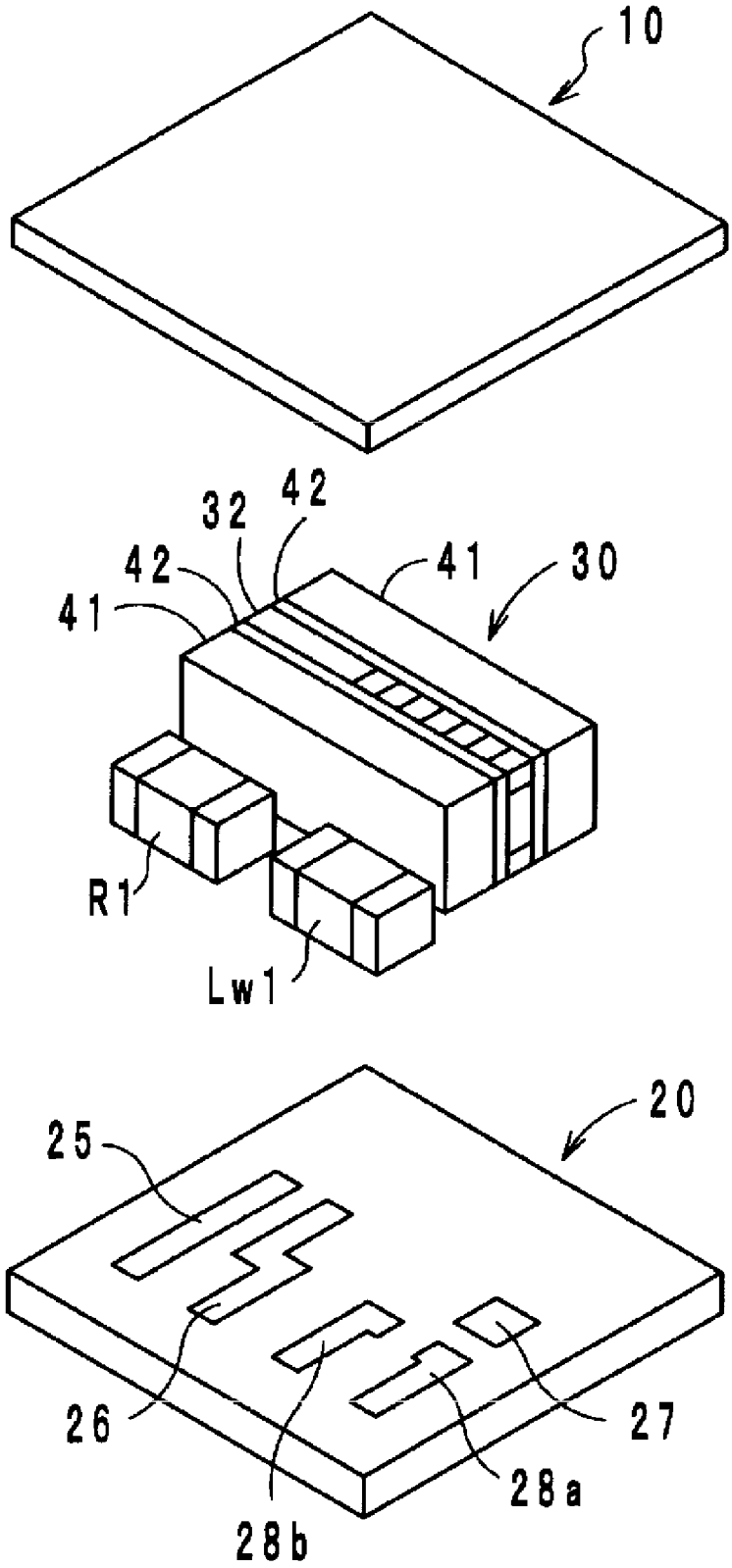
FIG. 1 is an exploded perspective view of a nonreciprocal circuit element (two-port isolator) according to a first preferred embodiment of the present invention.

A nonreciprocal circuit element according to preferred embodiments of the present invention will be described below with reference to the accompanying drawings. In the drawings, the same reference numeral is used to represent the same component or the same part so as to avoid repeated explanation.

First Preferred Embodiment

A nonreciprocal circuit element (two-port isolator) according to the first preferred embodiment preferably is a lumped-constant isolator, and includes a circuit board 20, a ferrite-magnet assembly 30 including a ferrite 32 and a pair of permanent magnets 41, a substantially planar yoke 10, a chip resistor R1, and a chip inductor Lw1 as illustrated in FIG. 1.

Figure 2:
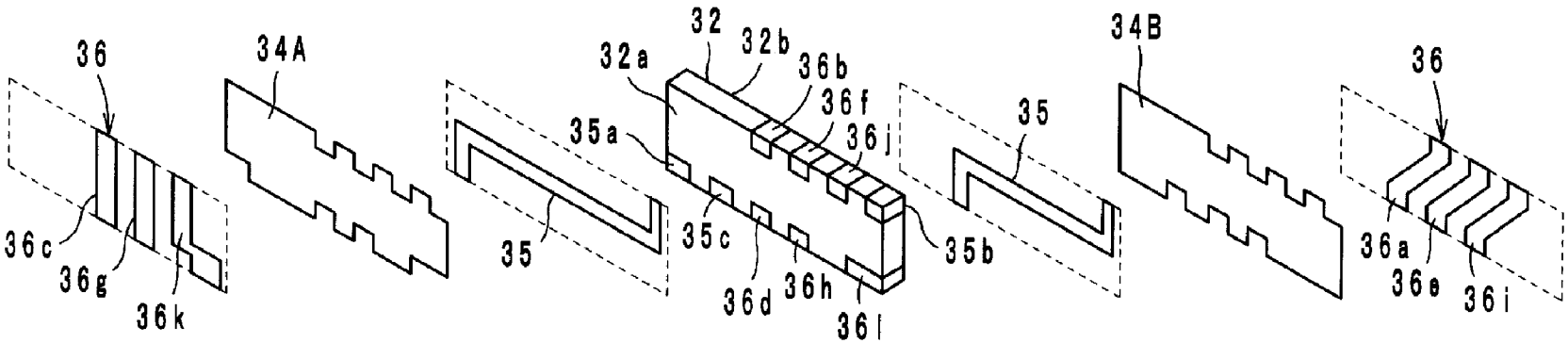
FIG. 2 is an exploded perspective view of a ferrite including center electrodes.

As illustrated in FIG. 2, in the ferrite 32, a first center electrode 35 and a second center electrode 36 are electrically insulated from each other by an insulating material 34A on a first main surface 32*a*, and the first center electrode 35 and the second center electrode 36 are electrically insulated from each other by an insulating material 34B on a second main surface 32*b*. The ferrite 32 preferably has a substantially rectangular parallelepiped shape, for example, including the first main surface 32*a* and the second main surface 32*b* that face each other and are parallel or substantially to each other.

The permanent magnets 41 are individually bonded to the main surfaces 32*a* and 32*b* of the ferrite 32 with, for example, an epoxy adhesive 42 (see FIG. 1) so that the permanent magnets 41 individually face the main surfaces 32*a* and 32*b* and a magnetic field is vertically applied to the main surfaces 32*a* and 32*b*. As a result, the ferrite-magnet assembly 30 is provided. Main surfaces of the permanent magnets 41 are substantially the same size as the main surfaces 32*a* and 32*b* of the ferrite 32. The permanent magnets 41 and the ferrite 32 are disposed so that the main surface of one of the permanent magnets 41 and the main surface of the other one of the permanent magnets 41 individually face the main surfaces 32*a* and 32*b* of the ferrite 32 and the contours of the permanent magnets 41 match the contour of the ferrite 32.

The first center electrode 35 is preferably defined by a conductive film. As illustrated in FIG. 2, the first center electrode 35 connected to a connection electrode 35*a* located on the undersurface of the ferrite 32 extends upward from a lower left portion of the first main surface 32*a*, extends in a substantially horizontal direction, extends upward toward an upper right portion of the first main surface 32*a*, and then turns toward the second main surface 32*b* via a relay electrode 35*b* provided on the upper surface of the ferrite 32. The first center electrode 35 on the second main surface 32*b* substantially overlaps with the first main surface 32*a* in a perspective view, and one end of the first center electrode 35 is connected to a connection electrode 35*c* located on the undersurface of the ferrite 32. Thus, the first center electrode 35 is wound around the ferrite 32 by one turn. The first center electrode 35 and the second center electrode 36 between which the insulating materials 34A and 34B are disposed are insulated from each other and intersect. In order to adjust an input impedance and an insertion loss, the intersection angle between the center electrodes 35 and 36 is set.

The second center electrode 36 is also preferably defined by a conductive film. In the second center electrode 36, a 0.5th-turn portion 36*a* connected to the connection electrode 35*c* provided on the undersurface of the ferrite 32 extends diagonally so that it intersects the first center electrode 35 on the second main surface 32*b*, turns toward the first main surface 32*a* via a relay electrode 36*b* located on the upper surface of the ferrite 32, and is then connected to a 1st-turn portion 36*c* perpendicular or substantially perpendicular to the first center electrode 35 on the first main surface 32*a*. The 1st-turn portion 36*c* turns toward the second main surface 32*b* via a relay electrode 36*d* provided on the undersurface of the ferrite 32 and is then connected to a 1.5th-turn portion 36*e*. The 1.5th-turn portion 36*e* extends diagonally on the second main surface 32*b* and then turns toward the first main surface 32*a* via a relay electrode 36*f* provided on the upper surface of the ferrite 32. In a similar manner, a 2nd-turn portion 36*g*, a relay electrode 36*h*, a 2.5th-turn portion 36*i*, a relay electrode 36*j*, and a 3rd-turn portion 36*k* are provided on the corresponding surfaces of the ferrite 32. The lower end of the 3rd-turn portion 36*k* is connected to a connection electrode 36*l* located on the undersurface of the ferrite 32.

The connection electrodes 35*a*, 35*c*, and 36*l* and the relay electrodes 35*b*, 36*b*, 36*d*, 36*f*, 36*h*, and 36*j* are preferably formed by applying or putting an electrode conductor to or into corresponding recesses provided on the upper surface and the undersurface of the ferrite 32. These electrodes are formed preferably by forming through holes in a mother ferrite substrate, filling the through holes with electrode conductors, and then cutting the substrate along a line that separates the through holes. Alternatively, these various electrodes may be formed as conductive films in through holes. When a multiple-production method is used, a mother ferrite substrate on which a permanent magnet is laminated using an adhesive may be cut.

A strontium, barium, or lanthanum-cobalt ferrite magnet is preferably used as the permanent magnet 41. A one-part thermosetting epoxy adhesive is preferably used as the epoxy adhesive 42 that bonds the permanent magnets 41 and the ferrite 32.

The circuit board 20 is a laminated circuit board obtained by forming predetermined electrodes on a plurality of dielectric sheets, laminating these sheets, and sintering the laminate. As illustrated in an equivalent circuit diagram in FIG. 3, the circuit board 20 includes matching capacitors C1 and C2, impedance matching capacitors Cs1 and Cs2, and a capacitor Cw1 included in a parallel resonant circuit according to the first preferred embodiment to be described later. On the upper surface of the circuit board 20, an input terminal electrode 25, an output terminal electrode 26, a ground terminal electrode 27, and connection terminal electrodes 28*a* and 28*b* are provided. On the undersurface of the circuit board 20, an external input terminal electrode IN, an external output terminal electrode OUT, and an external ground terminal electrode GND are provided. A terminating resistor R1 illustrated in the equivalent circuit diagram and an inductor included in the parallel resonant circuit are externally mounted on the circuit board 20 as the chip resistor R1 and the chip inductor Lw1, respectively.

The substantially planar yoke 10 has an electromagnetic shielding function, and is fixed to the upper surface of the ferrite-magnet assembly 30 via an adhesive.

Figure 3:
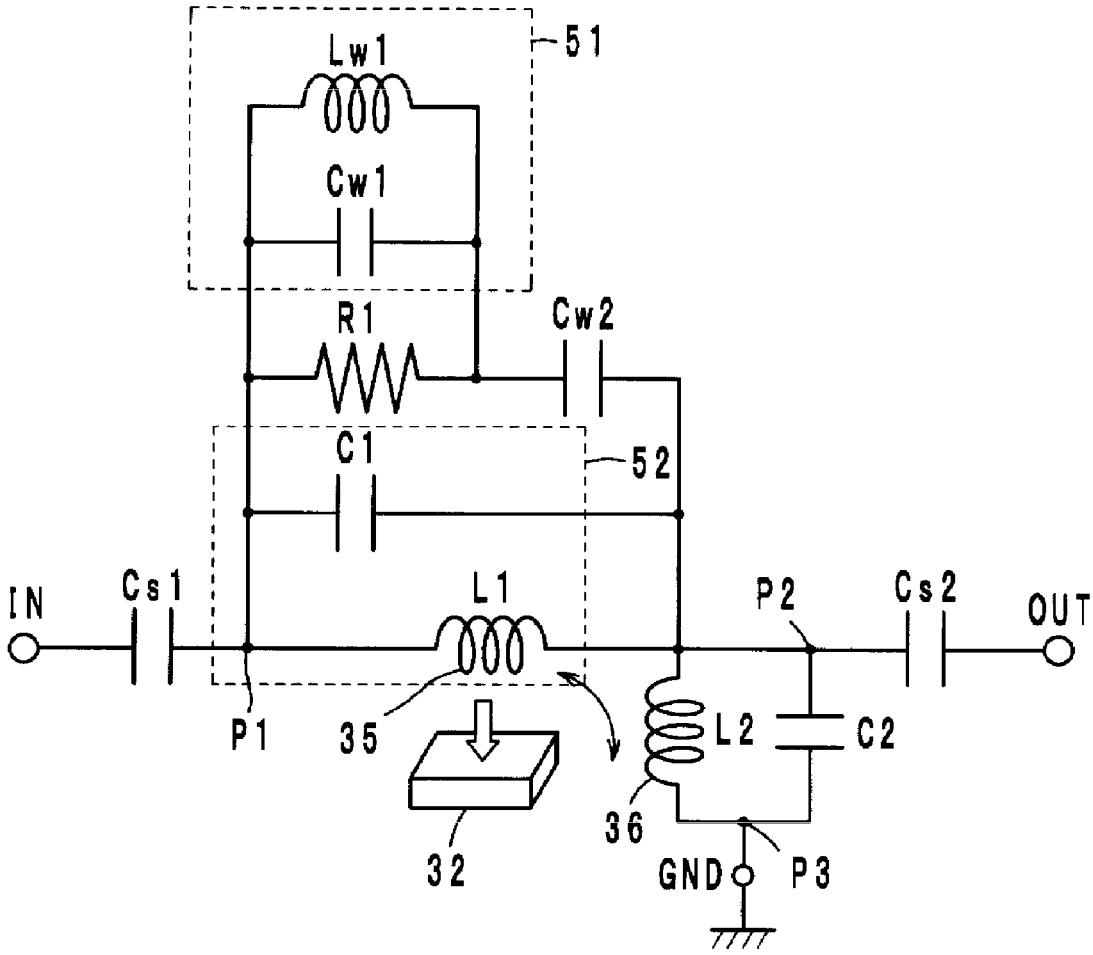
FIG. 3 is an equivalent circuit diagram of a nonreciprocal circuit element according to the first preferred embodiment of the present invention.

A circuit configuration according to the first preferred embodiment will be described with reference to the equivalent circuit diagram in FIG. 3. One end (an input port P1) of the first center electrode 35 is connected to the external input terminal electrode IN via the impedance matching capacitor Cs1. The other end of the first center electrode 35 and one end (an output port P2) of the second center electrode 36 are connected to the external output terminal electrode OUT via the impedance matching capacitor Cs2. The other end of the second center electrode 36 is connected to the external ground terminal electrode GND (a ground port P3).

The matching capacitor C1 is connected in parallel to the first center electrode 35 (L1) between the input port P1 and the output port P2. A matching capacitor C2 is connected in parallel to the second center electrode 36 (L2) between the output port P2 and the ground port P3. An LC parallel resonant circuit 51 (including the inductor Lw1 and the capacitor Cw1) is connected in parallel to the chip resistor R1 between the input port P1 and the output port P2. A capacitor Cw2 is connected between the LC parallel resonant circuit 51 and an LC parallel resonant circuit 52 (including the first center electrode 35 (L1) and the matching capacitor C1) so as to connect the LC parallel resonant circuits 51 and 52.

In a two-port isolator having the above-described circuit configuration, when a high-frequency current is input into the input port P1, a large high-frequency current flows through the second center electrode 36 and a high-frequency current hardly flows through the first center electrode 35. An insertion loss becomes small and the two-port isolator operates in a wide frequency band. During this operation, the high-frequency current hardly flows through the resistor R1 and the LC parallel resonant circuit 51. Accordingly, an insertion loss resulting from insertion of the LC parallel resonant circuit 51 can be ignored, and the insertion loss is not increased.

On the other hand, when a high-frequency current is input into the output port P2, impedance characteristics of the resistor R1 and the LC parallel resonant circuit 51 achieve matching in a wide frequency band. As a result, an isolation characteristic is improved.

An insertion loss characteristic and an isolation characteristic of a two-port isolator according to the first preferred embodiment will be described with reference to FIGS. 4 and 5. An insertion loss characteristic and an isolation characteristic are based on pieces of data of measurement performed on a two-port isolator having the following specifications.

Figure 4:
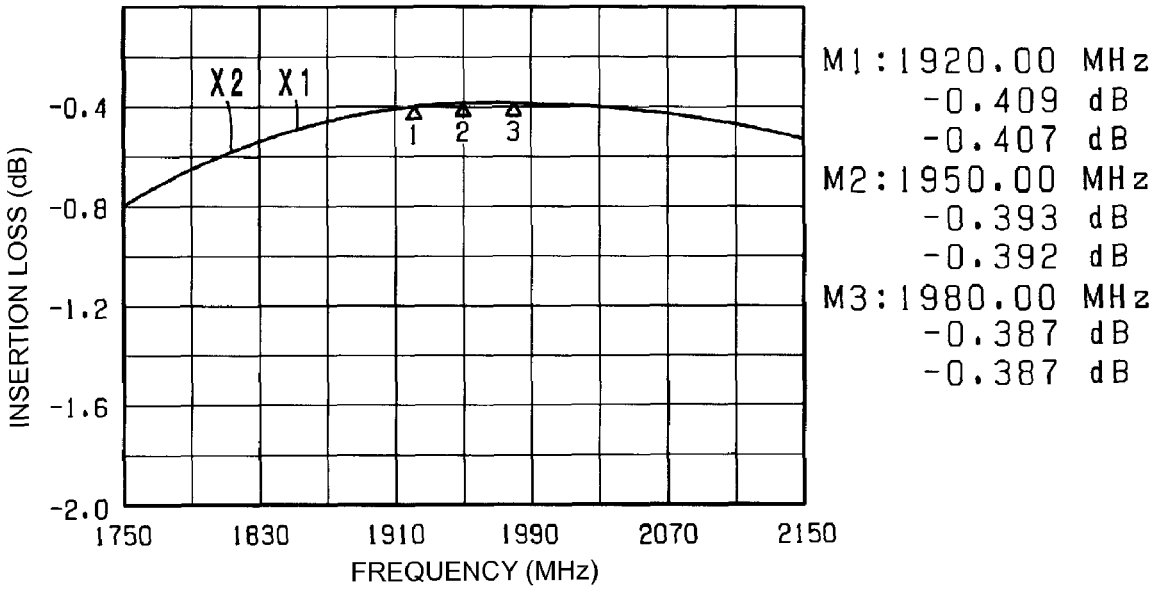
FIG. 4 is a graph indicating an insertion loss characteristic of a nonreciprocal circuit element according to the first preferred embodiment of the present invention.
Figure 5:
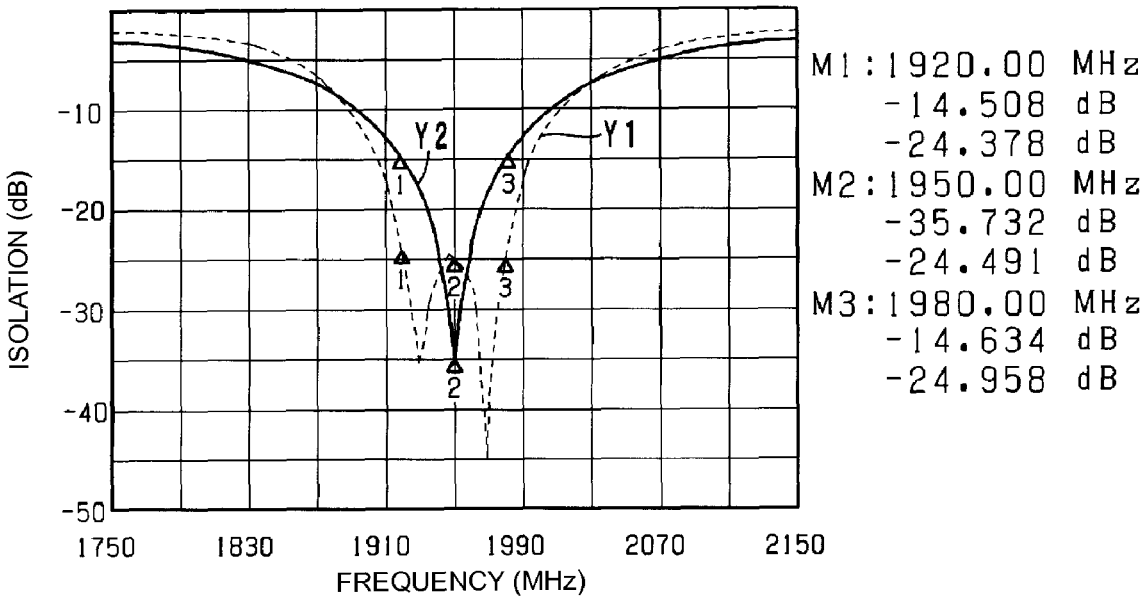
FIG. 5 is a graph indicating an isolation characteristic of a nonreciprocal circuit element according to the first preferred embodiment of the present invention.

Inductor L1: approximately 2.50 nH
Inductor L2: approximately 6.53 nH
Capacitor C1: approximately 2.62 pF
Capacitor C2: approximately 1.02 pF
Capacitor Cs1: approximately 2.70 pF
Capacitor Cs2: approximately 3.20 pF
Resistor R1: approximately 262 Ω
Inductor Lw1: approximately 1.00 nH
Capacitor Cw1: approximately 6.37 pF
Capacitor Cw2: approximately 0.30 pF FIG. 4 illustrates an insertion loss characteristic X1 of a two-port isolator according to the first preferred embodiment and an insertion loss characteristic X2 of a two-port isolator that is a comparative example and does not include the LC parallel resonant circuit 51 and the capacitor Cw2. The insertion loss characteristics X1 and X2 are substantially the same and overlap each other. That is, the insertion of the LC parallel resonant circuit 51 does not increase an insertion loss. FIG. 5 illustrates an isolation characteristic Y1 of a two-port isolator according to the first preferred embodiment and an isolation characteristic Y2 of a two-port isolator that is a comparative example and does not include the LC parallel resonant circuit 51 and the capacitor Cw2.

In the range of approximately 1920 MHz to approximately 1980 MHz, an insertion loss characteristic equal to or larger than approximately −0.41 dB is obtained in the first preferred embodiment and the comparative example, an isolation characteristic equal to or smaller than approximately −24.4 dB is obtained in the first preferred embodiment, and an isolation characteristic equal to smaller than approximately −14.5 dB is obtained in the comparative example. In the isolation characteristic of a two-port isolator according to the first preferred embodiment, two poles are defined by the LC parallel resonant circuits 51 and 52.

The inductor Lw1 included in the LC parallel resonant circuit 51 may have a small inductance value, for example, several nH, and can operate at up to approximately 6 GHz that is the self-resonance frequency of a small chip coil with a length of approximately 0.6 mm, a width of approximately 0.3 mm, and a height of approximately 0.3 mm, for example. Since the allowable current of a chip coil having an inductance value equal to or smaller than several nH is large, an electrode is not broken by high-frequency power reflected from an antenna. Accordingly, reliability is increased. Furthermore, since the capacitor Cw1 included in the LC parallel resonant circuit 51 has a relatively large capacitance value, for example, several pF, the amount of change in an effective capacitance value is small even if there are some changes in a stray capacitance. Accordingly, the variation in an isolation characteristic is prevented and minimized.

By setting the temperature characteristic of an inductance of the inductor Lw1 and the temperature characteristic of a capacitance of the capacitor Cw1 so that they are opposite in a polarity sign and are nearly equal in an absolute value, a nonreciprocal circuit element having a small change in an isolation characteristic with respect to the change in temperature can be obtained. Even if both of the above-described temperature characteristics are zero, similar advantageous effects can be obtained.

In the first preferred embodiment, the inductor Lw1 is preferably a chip coil and the capacitor Cw1 is preferably provided on the circuit board 20. In contrast, the inductor Lw1 may be provided on the circuit board 20 and the capacitor Cw1 may be a chip type component. Alternatively, both the inductor Lw1 and the capacitor Cw1 may be provided on the circuit board 20 or may be chip type components. Other elements also are not limited to the above-described elements.

Second Preferred Embodiment

Figure 6:
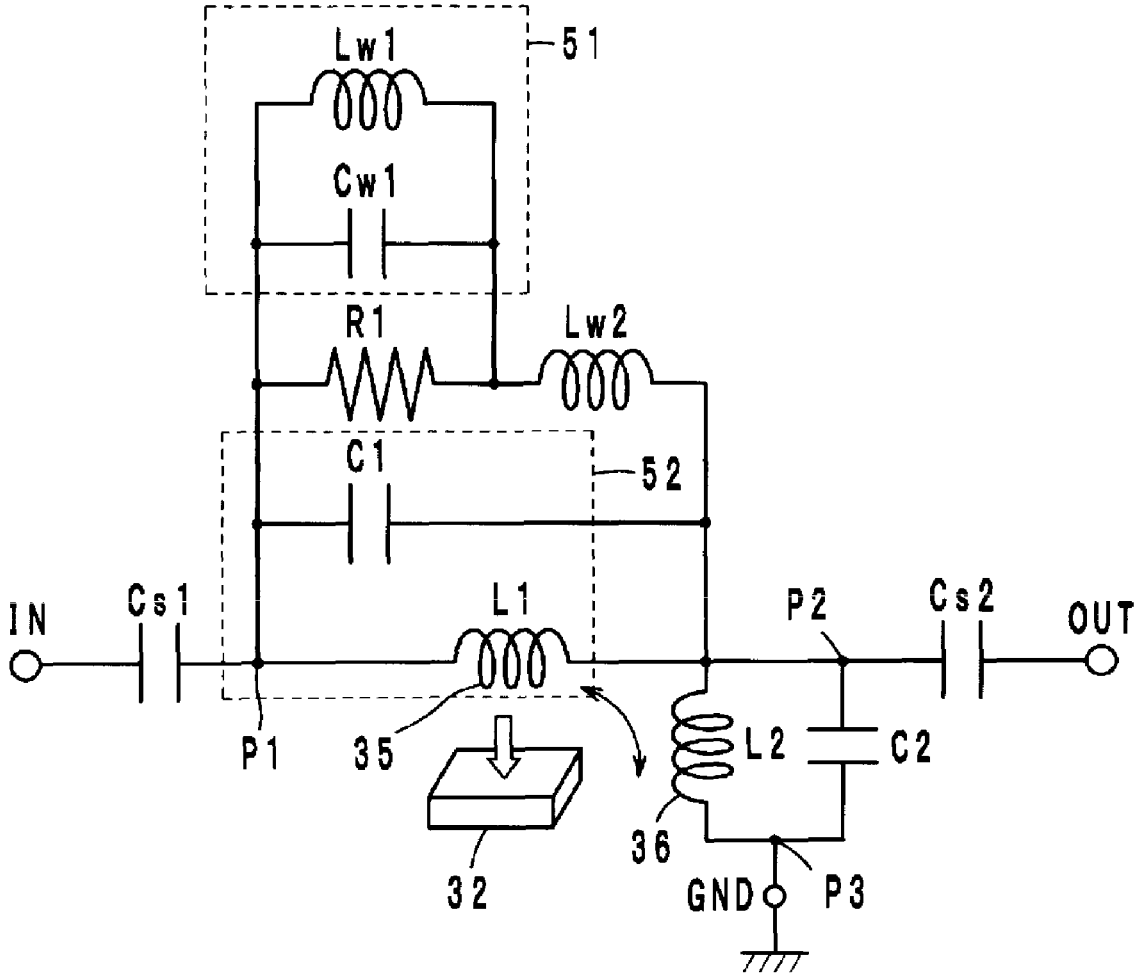
FIG. 6 is an equivalent circuit diagram of a nonreciprocal circuit element according to a second preferred embodiment of the present invention.

As illustrated in an equivalent circuit diagram in FIG. 6, a nonreciprocal circuit element (two-port isolator) according to the second preferred embodiment is preferably substantially the same as that according to the first preferred embodiment except that an inductor Lw2 is preferably used as an element to connect the LC parallel resonant circuits 51 and 52. Accordingly, in the second preferred embodiment, operational effects and advantages similar to that obtained in the first preferred embodiment can be obtained.

An insertion loss characteristic and an isolation characteristic of a two-port isolator according to the second preferred embodiment will be described with reference to FIGS. 7 and 8. An insertion loss characteristic and an isolation characteristic are based on pieces of data of measurement performed on a two-port isolator having the following specifications.

Figure 7:
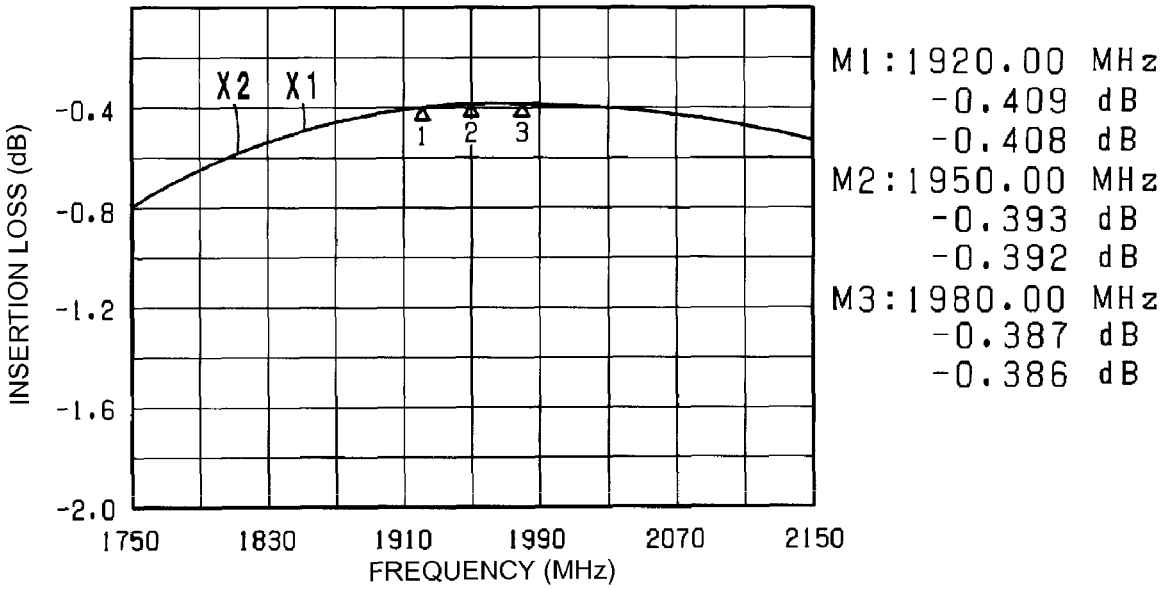
FIG. 7 is a graph indicating an insertion loss characteristic of a nonreciprocal circuit element according to the second preferred embodiment of the present invention.
Figure 8:
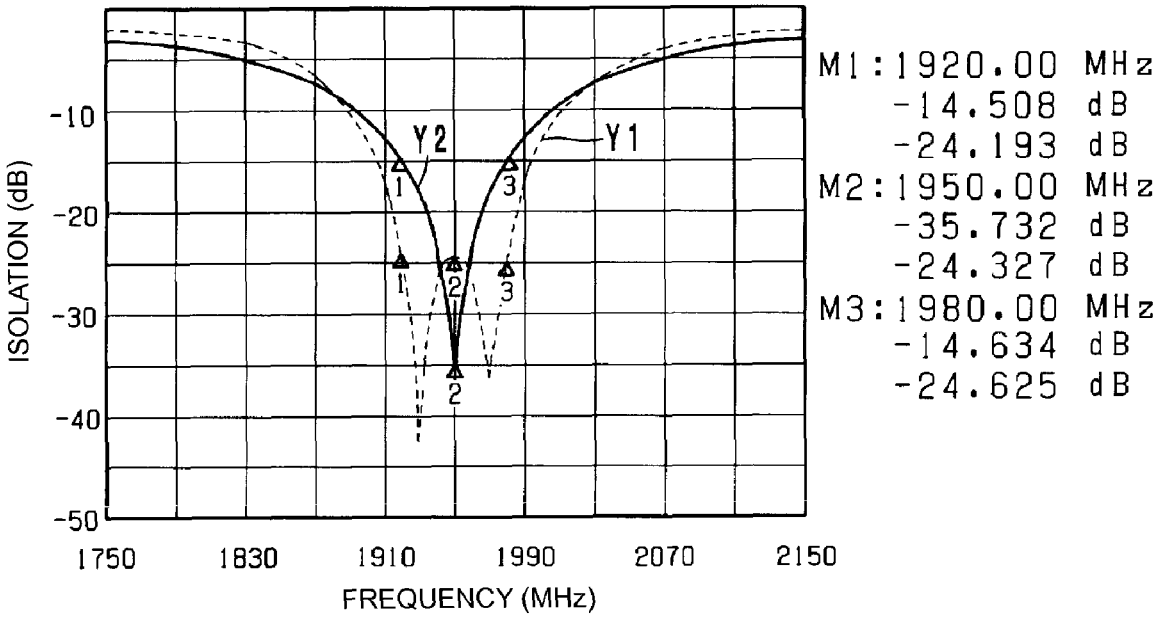
FIG. 8 is a graph indicating an isolation characteristic of a nonreciprocal circuit element according to the second preferred embodiment of the present invention.

Inductor L1: approximately 2.50 nH
Inductor L2: approximately 6.60 nH
Capacitor C1: approximately 3.21 pF
Capacitor C2: approximately 1.01 pF
Capacitor Cs1: approximately 2.60 pF
Capacitor Cs2: approximately 3.30 pF
Resistor R1: approximately 243 Ω
Inductor Lw1: approximately 1.00 nH
Capacitor Cw1: approximately 6.95 pF
Inductor Lw2: approximately 22.00 pF FIG. 7 illustrates an insertion loss characteristic X1 of a two-port isolator according to the second preferred embodiment and an insertion loss characteristic X2 of a two-port isolator that is a comparative example and does not include the LC parallel resonant circuit 51 and the inductor Lw2. The insertion loss characteristics X1 and X2 are substantially the same and overlap each other. That is, the insertion of the LC parallel resonant circuit 51 does not increase an insertion loss. FIG. 8 illustrates an isolation characteristic Y1 of a two-port isolator according to the second preferred embodiment and an isolation characteristic Y2 of a two-port isolator that is a comparative example and does not include the LC parallel resonant circuit 51 and the inductor Lw2.

In the range of approximately 1920 MHz to approximately 1980 MHz, an insertion loss characteristic equal to or larger than approximately −0.41 dB is obtained in the second preferred embodiment and the comparative example, an isolation characteristic equal to or smaller than approximately −24.2 dB is obtained in the second preferred embodiment, and an isolation characteristic equal to smaller than approximately −14.5 dB is obtained in the comparative example.

Third Preferred Embodiment

Figure 9:
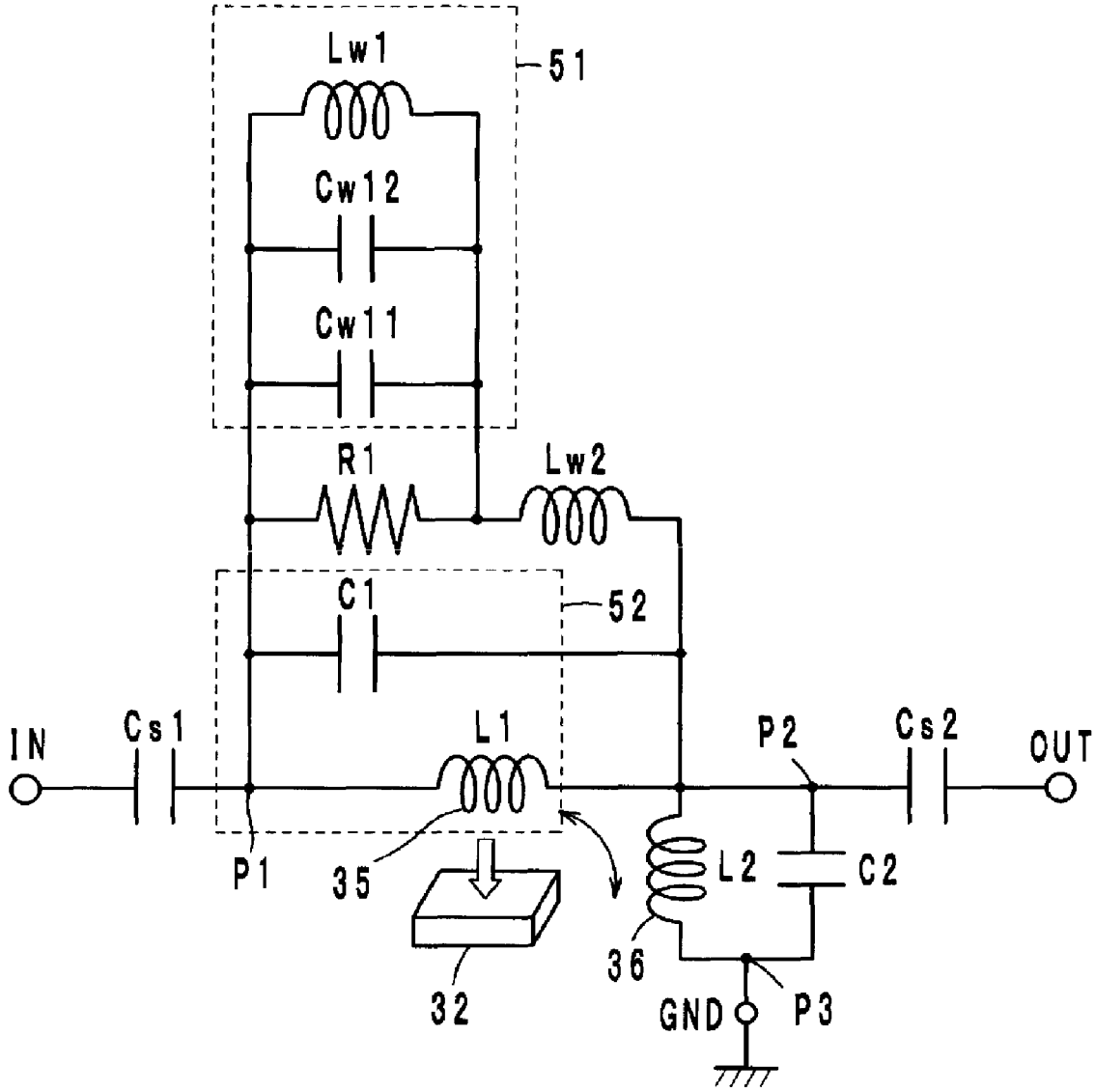
FIG. 9 is an equivalent circuit diagram of a nonreciprocal circuit element according to a third preferred embodiment of the present invention.

As illustrated in an equivalent circuit diagram in FIG. 9, a nonreciprocal circuit element (two-port isolator) according to the third preferred embodiment is preferably substantially the same as that according to the second preferred embodiment except that two capacitors Cw11 and Cw12 are used instead of the capacitor Cw1 in the LC parallel resonant circuit 51. Accordingly, in the third preferred embodiment, operational effects and advantages described in the first preferred embodiment can be obtained.

There is a certain variation in a capacitance value of a capacitor. The variation in a capacitance value in a case where two capacitors are used is smaller than that in a case where a single capacitor is used. The reason for this is that, when a capacitance value standard deviation in a case where n capacitors are used is calculated under the assumption that the distribution of the variation in a capacitance value of a single capacitor is a normal distribution and a capacitance value standard deviation in this case is $\sigma$, a calculation result of $\sigma/\sqrt{n}$ is obtained. When either or both of the capacitors Cw11 and Cw12 are formed on the circuit board 20, a nonreciprocal circuit element can be reduced in size.

Instead of the inductor Lw2, the capacitor Cw2 may be used. Instead of the inductor Lw1 included in the LC parallel resonant circuit 51, two or more elements may be used. Instead of the capacitors Cw11 and Cw12, three or more elements may be used. These elements may be chip type elements or may be provided on the circuit board 20.

Other Preferred Embodiments

The present invention is not limited to nonreciprocal circuit elements according to the above-described preferred embodiments, and various changes can be made to a nonreciprocal circuit element according to a preferred embodiment of the present invention without departing from the spirit and scope of the present invention.

For example, when the N-S polarity of the permanent magnet 41 is reversed, the input port P1 and the output port P2 change places. The shapes of the first center electrode 35 and the second center electrode 36 can be changed. The number of turns in the second center electrode 36 may be one or more.

As described previously, various preferred embodiments of the present invention are useful for a nonreciprocal circuit element, and, in particular, have advantage in their suitability for improving an isolation characteristic while maintaining an insertion loss characteristic, reliably operating in a high frequency band, and preventing variations in the isolation characteristic.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A nonreciprocal circuit element comprising:
a permanent magnet;
a ferrite arranged to receive a direct-current magnetic field from the permanent magnet;
first and a second center electrodes that intersect with but are isolated from each other; wherein
the first center electrode is disposed on the ferrite, and includes a first end electrically connected to an input port and a second end electrically connected to an output port;
the second center electrode is disposed on the ferrite, and includes a first end electrically connected to the output port and a second end electrically connected to a ground port;
a first matching capacitor is electrically connected between the input port and the output port;
a second matching capacitor is electrically connected between the output port and the ground port;
a resistor electrically connected between the input port and the output port;
a first parallel resonant circuit including an inductor and a capacitor is connected in parallel to the resistor; and
a coupling element connecting the first parallel resonant circuit and a second parallel resonant circuit including the first center electrode and the first matching capacitor is electrically connected between the first and second parallel resonant circuits.

2. The nonreciprocal circuit element according to claim 1, wherein the coupling element includes a capacitance element.

3. The nonreciprocal circuit element according to claim 1, wherein the coupling element includes an inductance element.

4. The nonreciprocal circuit element according to claim 2, wherein the capacitance element or the inductance element includes a plurality of elements.

* * * * *